United States Patent [19]

Blanken et al.

[11] Patent Number: 4,523,124

[45] Date of Patent: Jun. 11, 1985

[54] CATHODE-RAY TUBE HAVING MULTIPLATE CATHODE UNIT

[75] Inventors: Jacob Blanken; Paul J. Van Rijswijck, both of Eindhoven, Netherlands

[73] Assignee: U.S. Philips Corporation, New York, N.Y.

[21] Appl. No.: 401,456

[22] Filed: Jul. 26, 1982

[30] Foreign Application Priority Data

Aug. 14, 1981 [NL] Netherlands ..... 8103814

[51] Int. Cl.[3] ..... H01J 29/48

[52] U.S. Cl. ..... 313/446; 313/451

[58] Field of Search ..... 313/38, 446, 451, 456, 313/476, 270, 337

[56] References Cited

U.S. PATENT DOCUMENTS 4,379,980 4/1983 Takanashi et al. ..... 313/446

4,403,169 9/1983 Blanken ..... 313/446

*Primary Examiner*—David K. Moore
*Assistant Examiner*—K. Wieder
*Attorney, Agent, or Firm*—Robert J. Kraus

[57] ABSTRACT

A cathode-ray tube, such as a camera tube or a display tube, having an electron gun with a cathode unit including a cathode shank (30) suspended coaxially in an aperture in an assembly plate (38) and extending perpendicularly to the longitudinal axis of the electron gun. The cathode unit includes a metal supporting plate (41) which is accurately positioned with respect to the assembly plate (38). The assembly plate (38) and the supporting plate (41) each have two apertures through which supporting pins (44) for electrical connection lugs (32) extend. Glass plugs (43) connect the assembly plate (38), the supporting pins (44) and the supporting plate (41) together.

7 Claims, 7 Drawing Figures

CATHODE-RAY TUBE HAVING MULTIPLATE CATHODE UNIT

BACKGROUND OF THE INVENTION

The invention relates to a cathode-ray tube comprising in an evacuated envelope an electron gun for generating an electron beam and a target which is scanned by the electron beam. The electron gun comprises a cathode unit having a cup-shaped cathode shank provided coaxially around the longitudinal axis of the electron gun. The end face of the shank extends perpendicularly to the axis. A cathode filament is disposed in the shank and an emissive body is provided on the end face. The cathode shank is suspended coaxially in a central aperture in a metal assembly plate by means of thin suspension rods. The plate extends substantially perpendicularly to the axis and is connected to the suspension rods. The assembly plate comprises apertures in which supporting pins extending substantially parallel to the gun axis are provided by means of insulation material. Connection lugs for the cathode filament are connected to the supporting pins.

Such cathode-ray tubes have a very wide field of application and are used, for example, as television camera tubes, television display tubes, oscilloscope tubes and the like. In a television camera tube the target often is a photosensitive layer, for example a photoconductive layer, on a transparent signal electrode, which is provided on the inner wall of a window closing the envelope. In a television display tube and an oscilloscope tube the target comprises one or more phosphors luminescing in different colours which are provided on the inside of the display window of the tube in the form of one or more layers or of a pattern of lines or dots.

Such a cathode-ray tube is disclosed in Netherlands Patent Application No. 8002343, corresponding to U.S. Pat. No. 4,403,169. In one of the embodiments of the cathode unit described in said Application the metal assembly plate is connected to one end of a cathode supporting cylinder. Said cathode supporting cylinder is connected in a cup-shaped control electrode by means of a glass ring and a metal cylinder. Such a construction is rather laborious. Moreover, the components used must be manufactured very accurately and a comparatively large number of welding points are used.

Positioning the cathode shank in the cathode unit and positioning the cathode unit in the cup-shaped control electrode are difficult operations because the cathode unit has no clear reference face which may be used as a starting point in positioning.

SUMMARY OF THE INVENTION

It is an object of the invention to provide a cathode-ray tube having a cathode unit which is simple and accurate to manufacture and which cathode unit does have such a reference face.

According to the invention, a cathode-ray tube of the kind mentioned in the opening paragraph is characterized in that the cathode unit has a metal supporting plate which extends substantially parallel to the metal assembly plate and which has two apertures through which the supporting pins extend and which has at least one aperture for passing through the filament connections. The assembly plate and supporting pins and supporting plate are connected together by means of a plug of insulation material around each supporting pin. Such a construction provides a very compact cathode unit which is easy to assemble. The cathode shank is positioned with respect to the assembly plate and the cathode unit is positioned in the cup-shaped control electrode by means of the assembly plate. A surface of the assembly plate extending perpendicularly to the axis is used as a reference face. The cathode unit can be supported in a television camera tube by placing the supporting plate against a part of the surface of the inner wall of the envelope of the camera tube which extends perpendicularly to the tube axis. In that case the supporting plate is accurately positioned parallel to and at a given distance from the assembly plate. A camera tube having such an envelope is described, for example, in Netherlands Patent Application No. 8004230, corresponding to U.S. Pat. No. 4,479,073, which may be considered to be incorporated herein. The cathode unit may also be connected in a cup-shaped control electrode by means of a few spotwelds. In that case the supporting plate comprises at its edge a skirt extending parallel to the gun axis or at least two lugs extending parallel to the gun axis.

If the ends of the supporting pins are disposed in the apertures in the assembly plate and are fully embedded in insulation material, the possibility of electric insulation problems is smaller because material, if any, evaporated from the cathode can not in that case form a short-circuit between the assembly plate and the supporting pins.

In the axial direction the cathode shank can be positioned in the cathode unit very accurately by stretching thin suspension rods in such manner that upon being stretched the material of these suspension rods is drawn beyond the flow limit before the desired position with respect to the assembly plate is reached.

By providing the supporting plate with a central aperture it is possible to place, in the central apertures in the metal assembly plate and supporting plate, a known cylindrical metal heat reflection screen at a very small distance from the cathode shank coaxially around said cathode shank, which heat reflection screen overlaps the open end of the cathode shank and is connected to the assembly plate.

The invention may also be used in a colour display tube which comprises three electron guns which are each provided with a metal assembly plate and with one common supporting plate.

This common supporting plate may be connected in a common first cup-shaped control electrode. In such a common control electrode it is necessary to use cathode control because the electron beams cannot be controlled individually via the common control electrode. In that case the control signals are applied to the cathode shanks via the electrically insulated assembly plates. An electron gun system in which cathode control is used is described in U.S. Pat. No. 3,772,554.

BRIEF DESCRIPTION OF THE DRAWING

The invention will now be described in greater detail, by way of example, with reference to the accompanying drawing, in which.

DESCRIPTION OF THE PREFERRED EMBODIMENTS

Figure 1:
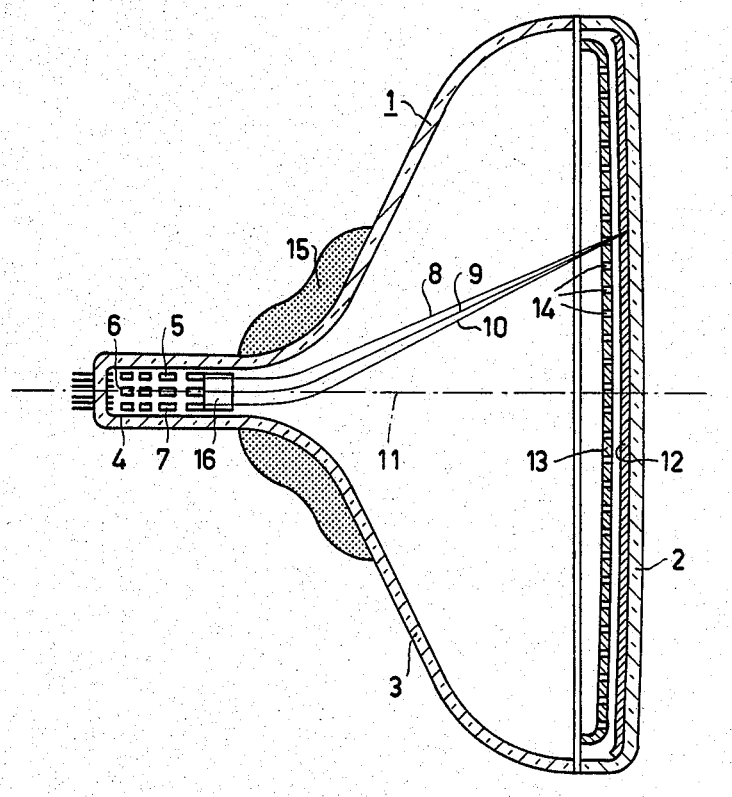
FIG. 1 is a longitudinal sectional view of a colour display tube according to the invention.

FIG. 1 is a sectional view of a cathode-ray tube according to the invention, in this case a colour display tube of the "in-line" type.

A glass envelope 1 comprises a display window 2, a funnel-like part 3 and a neck 4. In the neck three electron guns 5, 6 and 7 which generate the electron beams 8, 9 and 10, respectively, are provided. The longitudinal axes of the electron guns are located in one plane, the plane of the drawing. The axis of the central electron gun 6 coincides substantially with the tube axis 11. The three electron guns terminate in a sleeve 16 which is situated coaxially in the neck 4. The display window 2 has a large number of triplets of phosphor lines on its inside. Each triplet comprises a line consisting of a green-luminescing phosphor, a line consisting of a blue-luminescing phosphor and a line consisting of a red-luminescing phosphor.

All triplets together constitute the display screen 12. The phosphor lines are perpendicular to the plane of the drawing. In front of the display screen the shadow mask 13 is provided which has a very large number of elongate apertures 14 through which the electron beams 8, 9 and 10 emanate. The electron beams are deflected in a horizontal direction (in the plane of the drawing) over the display screen 12 and in a vertical direction (perpendicularly to the plane of the drawing) by the system of deflection coils 15. The three electron guns are assembled so that the axes thereof enclose a small angle with each other. As a result of this the electron beams pass through the apertures 14 at this angle, the so-called colour selection angle, and each impinges only on phosphor lines of one colour.

Figure 2:
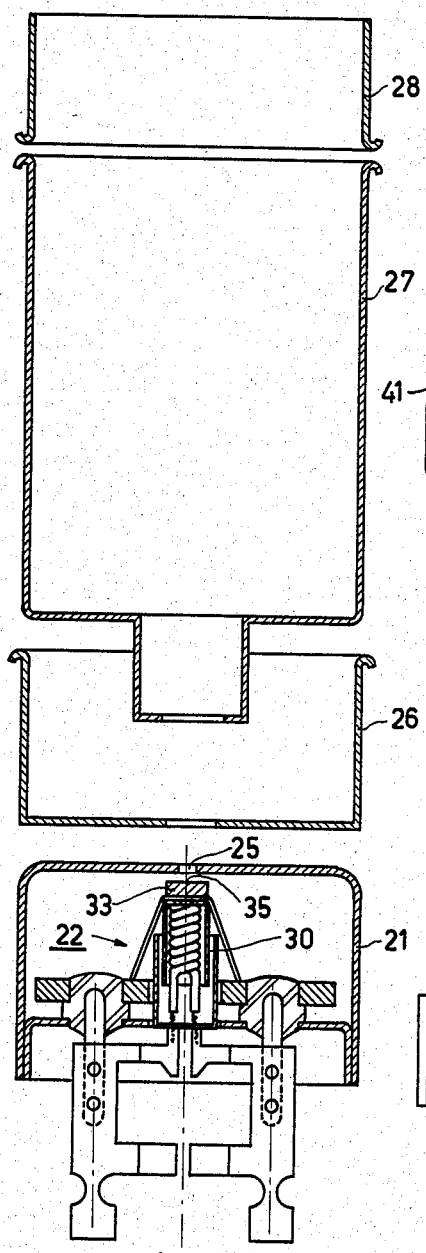
FIG. 2 is a longitudinal sectional view of one of the electron guns of the display tube shown in FIG. 1.

FIG. 2 is a longitudinal sectional view of one of the electron guns. A cathode unit 22 is present in the control electrode 21. The cathode unit has a cathode shank 30 having thereon an impregnated tungsten body 33 with an emissive surface 35. The emitted electron beam emanates through aperture 25 in the control electrode 21 which is situated opposite to the emissive surface 35 and is then accelerated and focused by means of the electrodes 26, 27 and 28. In a colour display tube the cathode potential is, for example, +30 Volts, the control electrode has, for example, a fixed potential of 0 Volts, the second electrode 26 has a potential of 1,000 Volts, the third electrode 27 has a potential of 6,000 Volts and the fourth electrode 28 has a potential of 27 kV. Such a cathode unit may, of course, also be used in a diode electron gun (for example, in television camera tubes). In a diode electron gun the cathode is usually succeeded by an anode which is at a positive voltage.

Figure 3:
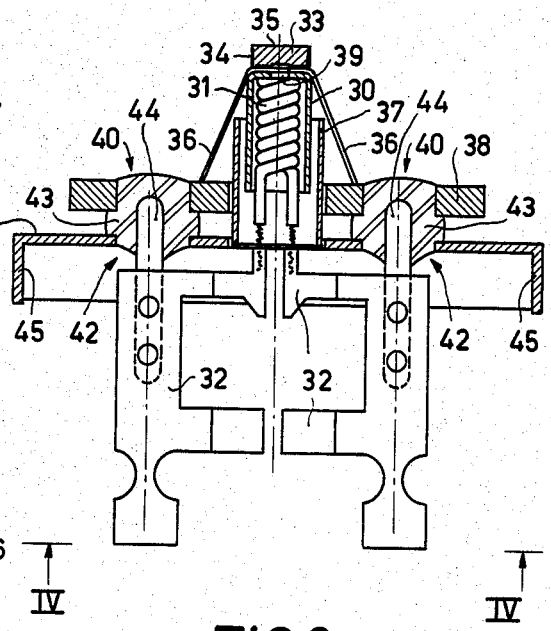
FIG. 3 is a detail of the sectional view of FIG. 2.

FIG. 3 is a sectional view of a cathode unit as used in the electron gun shown in FIG. 2. The components shown in FIG. 3 are shown as being enlarged approximately 10 times. Present in the cathode shank 30 is a cathode filament 31 which is connected to the connection lugs 32 of 0.075 mm thick NiFe. An impregnated tungsten body 33 in an envelope 34 and having an emissive surface 35 is provided on the 0.1 mm thick end face of the cathode shank 30 of molybdenum. The formation of the envelope around the tungsten body 33 forms the subject matter of Netherlands Patent Application No. 7608642 corresponding to U.S. Pat. No. 4,215,457. The cathode shank is suspended so as to be self-supporting and coaxial in the heat reflection screen 37 by means of thin metal suspension rods 36. The thin metal supporting rods 36 may be metal wires or metal strips. In this embodiment four wires of tungstenrhenium having a diameter of 0.05 mm and a length of approximately 2 mm are used. The wires are each connected at one end to the assembly plate 38 of 0.5 mm thick NiFe and at the other end between the holder 34 and the cathode shank 30. It is also possible, however, to use only two wires which are each secured with their two ends to the assembly plate 38 and which cross each other between the holder 34 and the cathode shank 30. At the crossing of the two wires the end face of the cathode shank is provided with an aperture 39 or a cavity so as to prevent assembly problems and to enable the crossing of the wires.

After welding the wires 36, they are stretched while positioning the cathode shank with respect to the assembly plate 38. In order to prevent the cathode shank from springing back after the adjustment, the wires 36 are elongated during this adjustment process in such manner that the material of the wires passes the flow limit. As a result of this it is possible to accurately position the cathode shank with the emissive surface 35 parallel to and at a desired distance from the assembly plate 38. As a result of this accurate positioning of the cathode shank it is possible to make the distance between the cathode shank and the heat reflection screen very small (0.2 mm), which optimizes the operation of the heat reflection screen. Two apertures 40 are provided in the assembly plate 38 and two apertures 42 are provided in the supporting plate 41. The supporting pins 44 to which the cathode connection lugs 32 are spotwelded are connected coaxially in said apertures by means of plugs 43 of glass ceramic. While connecting the assembly plate 38, the supporting pins 44 and the supporting plate 41 together these components are positioned with respect to each other in a mold. After the connection, the supporting plate 41 is provided with a skirt 45, the assembly plate 38 being used as a reference plate. When positioning the cathode unit shown in FIG. 3 in a cup-shaped control electrode, assembly plate 38 is again used as a reference plate. Therefore, the supporting plate 41 or the cup-shaped control electrode is often provided with one or more apertures so as to make the assembly plate accessible and visible.

Figure 4:
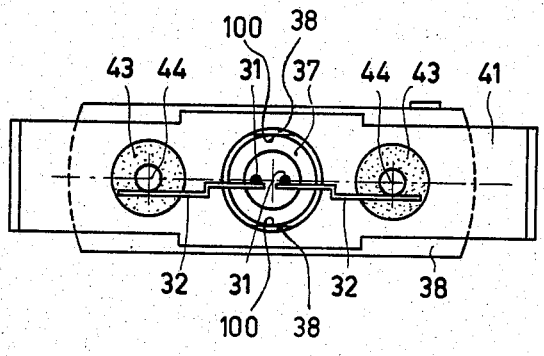
FIG. 4 is a bottom view of the detail shown in FIG. 3.

FIG. 4 is a bottom view of the cathode unit shown in FIG. 3. The reference numerals of the various components correspond to those of the same components in FIG. 3.

Figure 5:
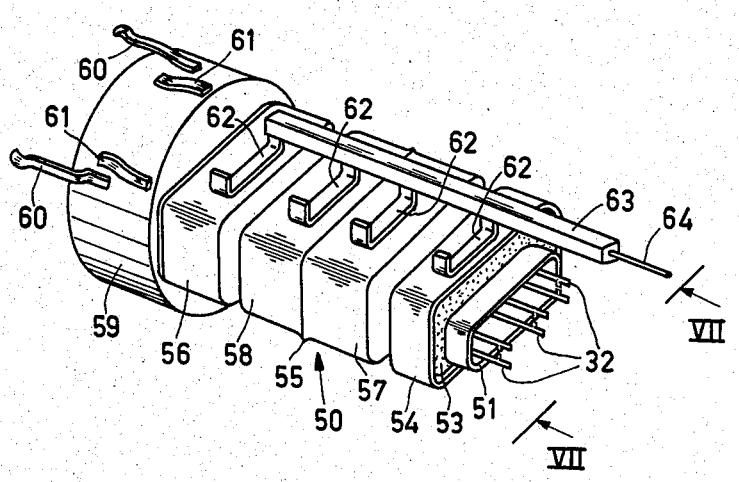
FIG. 5 is a perspective elevation of an integrated electron gun system for a colour display tube.

FIG. 5 is a perspective view of an integrated electron gun for a colour display tube. The electron gun system 50 comprises a common control electrode 51 in which three cathode units as shown in FIG. 3 are provided of which only the connection lugs 32 are visible in this Figure. This control electrode 51 is connected in a disk of ceramic material 53 which is connected in a cup-shaped second electrode 54. The electron beams are focused by means of the focusing electrodes 55 which are common for the three electron beams and the common accelerating electrode 56. The focusing electrode 55 consists of two cup-shaped parts 57 and 58 which are connected together at their open ends. A centring sleeve 59 having contact springs is connected on the accelerating electrode 56. The contact springs 61 make electrical contact with an electrically conductive layer provided internally on the tube wall. The centring springs 60 position the electron gun system 50 in the neck of the tube. The electrodes 54, 55 and 56 comprise braces 62 which are sealed in glass rods 63 of which only one is shown to avoid complexity of the drawing. The glass rods 63 each comprise a connection pin 64 for connecting the electron gun system to leadthrough pins in the so-called mount of the display tube.

Figure 6:
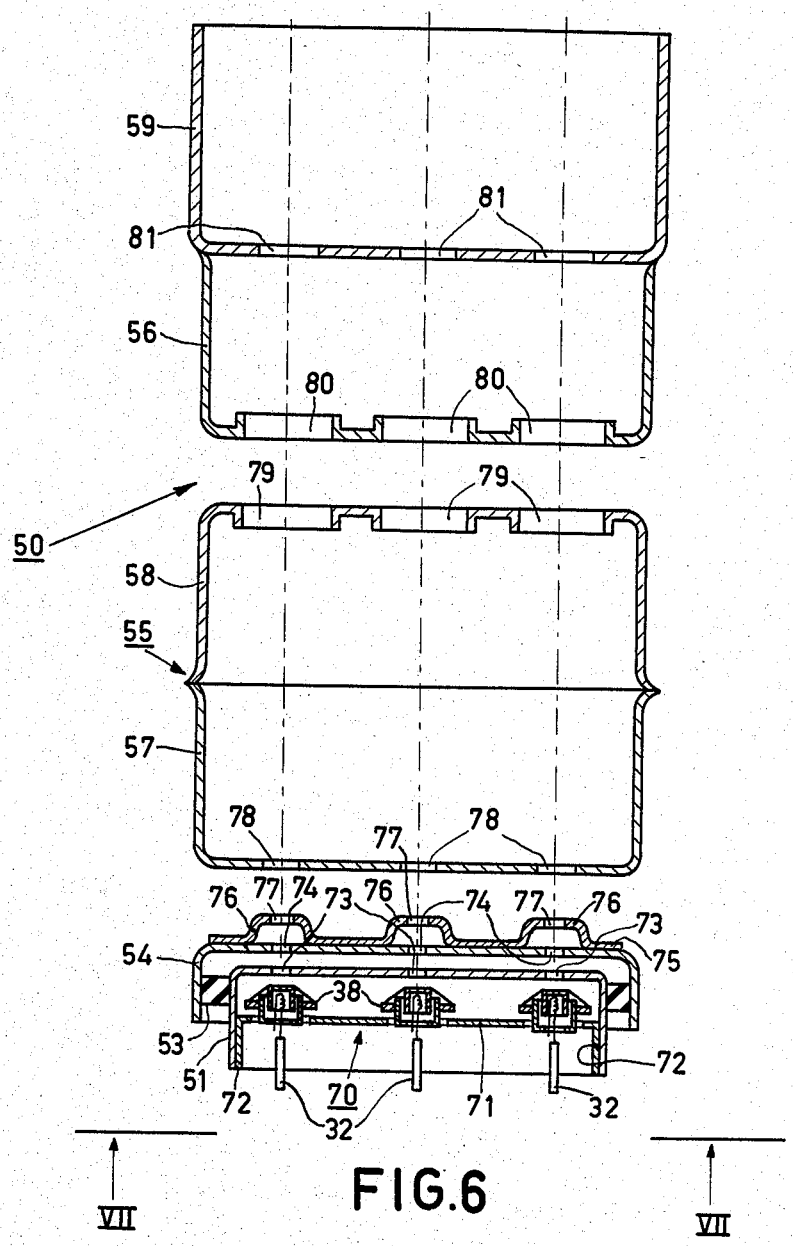
FIG. 6 is a sectional view through the axes of the three electron guns of the electron gun system shown in FIG. 5.

FIG. 6 is a sectional view through the axes of the three electron guns which together constitute the electron gun system shown in FIG. 5. Positioned inside the common cup-shaped control electrode 51 is a cathode unit 70 comprising three cathodes which are suspended in the manner as described with reference to FIG. 2, but having a common supporting plate 71 having a skirt 72 extending parallel to the gun axes and connected to the electrode 51 by means of spotwelds. Electrode 51 is connected in electrode 54 by means of a ceramic plate 53. Electrode 51 has three apertures 73 and electrode 54 has three apertures 74. A plate 75 connected to electrode 54 has three embossed parts 76 each having an aperture 77 which serves to restrict the cross-section of the respective electron beam in the focusing lens and to obtain in this manner the desired spot of the electron beams on the display screen. Focusing electrode 55 has apertures 78 and 79. The accelerating electrode 56 has apertures 80. A cup-shaped centring electrode 50 having apertures 81 is connected to the open end of the accelerating electrode 56. The dimensions of the components of and apertures in such an electron gun are elaborately described in Netherlands Patent Application No. 7904114 corresponding to U.S. Pat. No. 4,337,409, which may be considered to be incorporated by reference.

Figure 7:
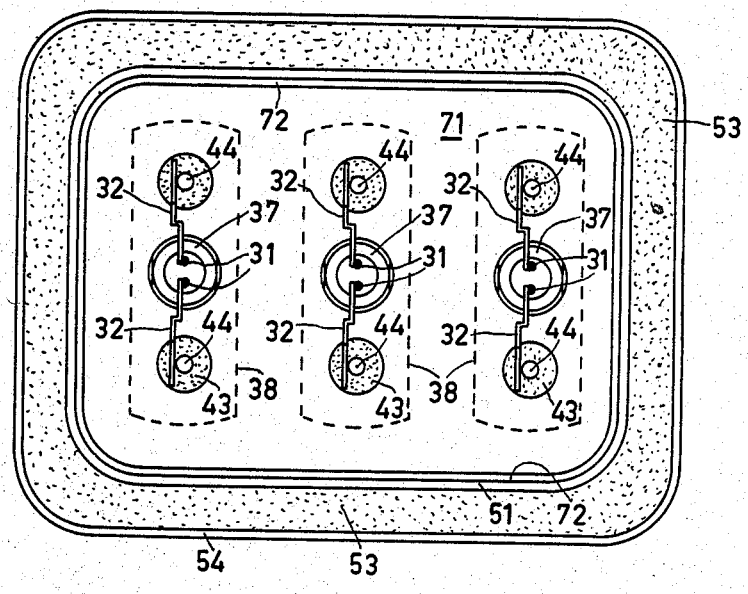
FIG. 7 is a bottom view of the integrated electron gun system shown in FIGS. 5 and 6.

FIG. 7 is a bottom view of the electron gun system shown in FIGS. 5 and 6. The reference numerals correspond to those used for the same elements in FIGS. 4, 5 and 6. The metal assembly plates 38 (FIG. 3) are shown in broken lines.

What is claimed is:

1. In a cathode-ray tube comprising an envelope containing a target and an electron gun for directing an electron beam at said target, said electron gun including a cathode unit comprising:

(a) an assembly plate extending perpendicularly to a longitudinal axis of the electron gun and having a central aperture and first and second outer apertures;

(b) a cup-shaped element coaxially-disposed around said axis and extending through said central aperture, said element having an emissive body disposed on an end face thereof and having a filament disposed therein;

(c) a plurality of suspension members extending from the cup-shaped element to the assembly plate for positioning said element with its end face parallel to and at a predetermined distance from a reference surface of said assembly plate;

(d) a supporting plate extending parallel to the assembly plate and having a central aperture for providing access to the filament and having first and second outer apertures adjacent the corresponding apertures in the assembly plate;

(e) first and second connection lugs electrically-connected to the filament of the cathode unit and attached to respective first and second supporting pins extending through the first and second openings in the supporting plate and into the first and second openings of the assembly plate; and (f) first and second plugs of insulation material surrounding the first and second supporting pins and engaging edges of the assembly plate and the supporting plate defining their respective first and second apertures, to attach the supporting plate and the connection lugs in predetermined positions with respect to the assembly plate.

2. A cathode-ray tube as in claim 1 characterized in that ends of the supporting pins extending into the apertures in the assembly plate are embedded in said plugs.

3. A cathode-ray tube as in claim 1 or 2 characterized in that said suspension members are suspension rods which have been stretched beyond their flow limit to position the cup-shaped element with respect to the assembly plate.

4. A cathode-ray tube as in claim 1 or 2 comprising a color display tube having three electron guns, each including a respective one of said assembly plates and each sharing a common supporting plate.

5. A cathode-ray tube as in claim 1 or 2 comprising a cylindrical heat reflection screen coaxially-disposed around the cup-shaped element and extending into the central apertures of the assembly plate and the supporting plate, said heat reflection screen overlapping an open end of said cup-shaped element and being attached to the assembly plate.

6. A cathode-ray tube as in claim 1 or 2 comprising a skirt extending from a peripheral edge of the supporting plate, said skirt being parallel to the longitudinal electron gun axis.

7. A cathode-ray tube as in claim 1 or 2 where said suspension members include first and second members which cross at the end face of the cup-shaped element, said end face having an opening adjacent to the place where said members cross.

* * * * *